US005494213A

United States Patent [19]

Mau

[11] Patent Number: 5,494,213

[45] Date of Patent: Feb. 27, 1996

[54] RAIL TO PLATE INTERCONNECTING RAIL SPIKE

[76] Inventor: Fred I. Mau, P.O. Box 71, Pymble NSW 2073, Canada

[21] Appl. No.: 380,555

[22] Filed: Jan. 30, 1995

[51] Int. Cl.[6] ..... E01B 9/00

[52] U.S. Cl. ..... 238/375; 411/450

[58] Field of Search ..... 238/366, 367, 238/375; 411/446, 450, 451, 452, 453, 455, 456

[56] References Cited

U.S. PATENT DOCUMENTS

| | | | |
|---|---|---|---|
| 631,489 | 8/1899 | Kennedy | 411/450 |
| 896,108 | 8/1908 | Heale | 411/450 |
| 1,119,686 | 12/1914 | Davis | 411/450 |
| 1,407,893 | 2/1922 | Smith | 238/375 |
| 2,196,534 | 4/1940 | Neal | 411/450 |
| 2,348,331 | 5/1944 | Couch | 238/366 |

*Primary Examiner*—Mark T. Le
*Attorney, Agent, or Firm*—Robert W. Jenny

[57] ABSTRACT

The subject spike has a rectangular shank having a front surface which faces the rail when the spike is driven into place, a back surface opposite the front surface and two side surfaces. There is a ledge on one side, perpendicular to the length of the spike. The ledge has a face facing the head of the spike and a distance from it such that when the spike is fully driven the ledge engages the underside of the plate which supports the rail. The other side of the shank is contoured to provide clearance for the ledge to pass through a standard sized hole in the plate and then to cam the spike sidewise to engage the ledge under the plate. This engagement attaches the rail flange to the plate and the spike helps attach both the rail and plate to the tie.

1 Claim, 1 Drawing Sheet

FIG. 1
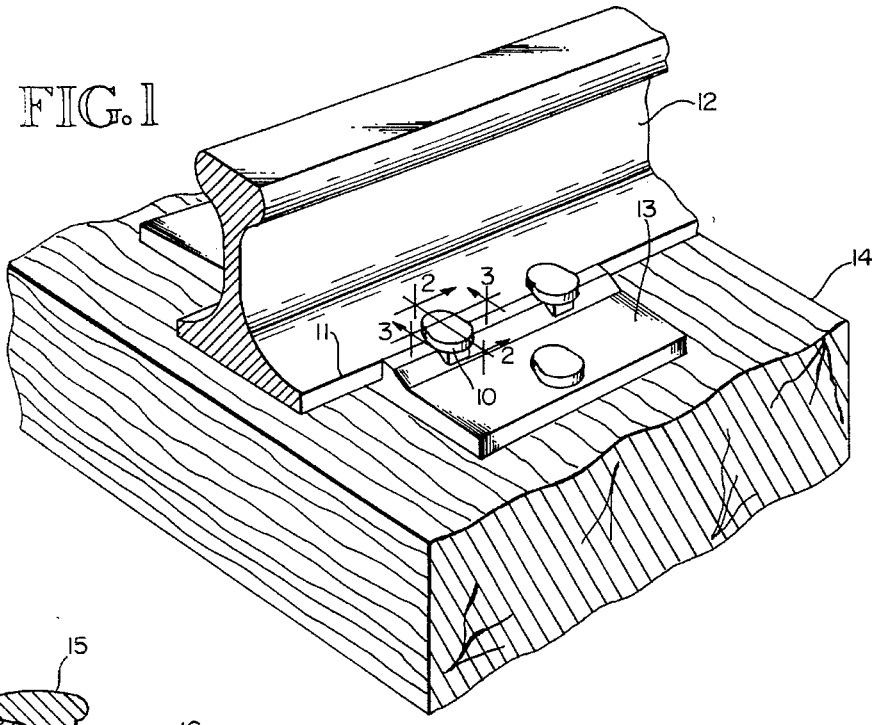
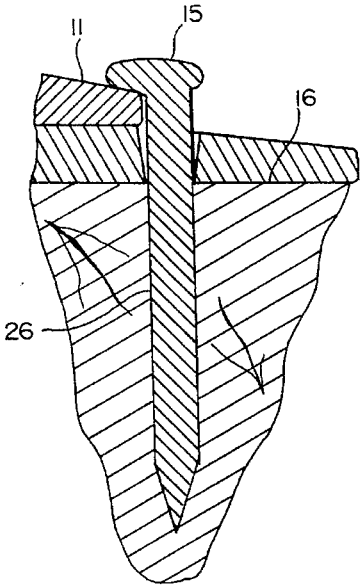
FIG. 2
FIG. 3
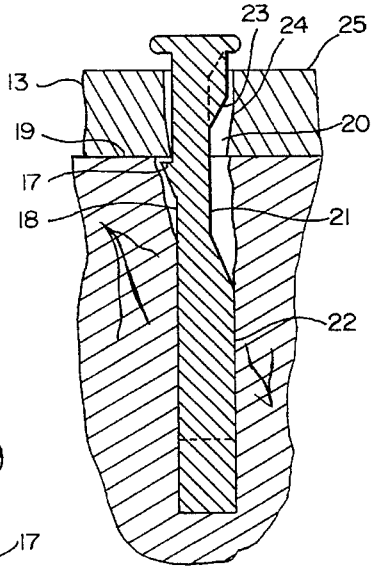
FIG. 5
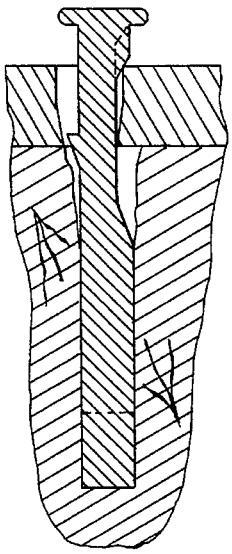
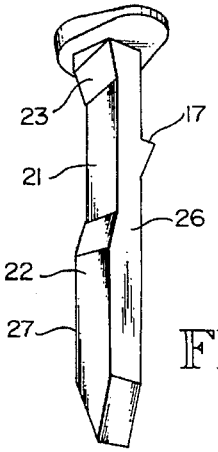
FIG. 4

RAIL TO PLATE INTERCONNECTING RAIL SPIKE

BACKGROUND OF THE INVENTION

1. Field

The subject Invention is in the field of heavy nails and spikes, particularly spikes used for attaching railroad rails to railroad ties in conjunction with plates set between the rails and ties. The plates distribute the loads applied by the rails on the ties over a larger area.

2. Prior Art

In the prior art, at points along the rail, the rail is fastened to a plate and a tie by spikes which go into the tie through holes in the plate and the heads of these spikes engage the edges of the flanges of the rail, thus providing attachment of the rail at a point and partial attachment of the plate to the tie at the same point. Additional spikes are driven through holes in the plate that provide further attachment of the plate to the tie. The loads on the rails from wheels rolling on the rails are not vertical, so that there is a horizontal component of the loads, applied to the rail and tending to move it sidewise and also to roll it over since the load is applied some distance above the flanges of the rail. The rail is prevented from rolling over by a force couple comprising an upward force between a rail flange and the plate at the edge of one flange and a downward force applied by the head of a spike onto the edge of the other flange. The limit of the restraint to rolling over is determined by the distance between the edges of the flanges and the force required to pull the spike out of the tie. This limit is generally regarded as inadequate. Two prior art techniques for raising this limit are (1) use of serrations or threads to increase the force needed to pull the spike from the tie and (2) using a clip which attaches the flange to the plate when the clip is held in place by a spike which is located close to the edge of the flange but which fastens the plate to the tie. The clip and spike fit in a hole in the plate which is normally occupied by a spike alone. Therefore, the spike used with the clip is a special spike and smaller than the standard spike. This technique is taught in U.S. Pat. No. 4,354,634, issued to Kasuba et al. Clipping the rail to the plate shifts the burden of preventing roll-over to the plate and the spikes attaching it to the tie. Since the plate is wider than the flanges of the rail and the spikes holding the plate to the tie are farther apart than the spikes attaching the rail, the resistance to roll-over is significantly increased. However, the increase is limited somewhat by the lower strength and holding capability of the smaller spike. Also, the need for another loose part adds to increased inventory and handling costs. Further, the load is transferred from the rail flange to the plate by the clip which, because of the need to put the clip and the spike in the standard size hole, is not as strong as a spike.

In view of these facts the prime objective of the subject invention is to provide a railroad spike which attaches the flange of a rail to the plate on which the rail is supported and also attaches the flange and plate to the tie on which the plate is supported. A second objective is that the cross sectional area of the spike be roughly equivalent to that of a standard spike so that the spike which is the subject invention is approximately equal in strength to a conventional spike of the same class.

SUMMARY OF THE INVENTION

The subject invention is a railroad spike which is driven with conventional techniques and which connects a flange of a rail to the plate supporting the rail while attaching both to the tie which is under the plate. For purposes of this disclosure the face of the shank of the spike which is overhung by the offset head of such spikes is termed the front of the spike. The opposite face is therefore the back of the spike and there are two sides extending from front to back. On one side of the spike there is a ledge extending from the side, parallel to the underside of the head of the spike and located a distance from the head such that when the spike is fully driven the ledge can engage the underside of the plate, capturing the flange of the rail and the plate between the ledge and the underside of the head.

The other side of the shank is contoured to first provide clearance so that the shank can deflect sideward to allow the ledge to pass through the hole in the plate and, second, to provide cam action between the shank and a side edge of the hole in the plate to force the spike sideward to cause the ledge to engage the underside of the plate. This spike fits the conventional hole in the plate and locks the rail flange to the plate while holding both to the tie. There are no loose parts and conventional spike driving tools and techniques are satisfactory.

The invention is described in more detail below with reference to the attached drawings.

BRIEF DESCRIPTION OF THE DRAWINGS

FIG. 1 is an illustration of the attachment of a section of railroad rail to a plate and a tie.

FIG. 2 is a section taken at 2—2 in FIG. 1.

FIG. 3 is a section taken at 3—3 in FIG. 1.

FIG. 4 is an isometric view of the subject spike showing the contoured side.

FIG. 5 is similar to FIG. 3 but with the spike positioned at the beginning of the camming action.

DETAILED DESCRIPTION OF THE INVENTION

The subject invention is a railroad spike which connects a rail flange to the plate supporting the rail and both the rail and the plate to a tie supporting the plate and rail. The subject spike 10 is shown in FIG. 1 engaging flange 11 of rail 12 which is supported on plate 13 which is supported on tie 14.

FIG. 2 is a section taken at 2—2 in FIG. 1. In this view the spike is conventional with its head 15 positioned to restrain flange 11 and thereby restrain both the rail and the plate against top surface 16 of the tie.

FIG. 3 is a section taken at 3—3 in FIG. 1. Ledge 17 on side 18 of the spike is engaged with undersurface 19 of plate 13. This engagement assures that the rail cannot roll over independently of the plate. Since the plate is wider than the rail and is held down by spikes in addition to those holding the rail and plate down, the rail can resist considerably greater moments tending to roll it over.

As the spike is being driven clearance must be provided for the ledge to pass through hole 20 in the plate. This clearance is provided by contour 21 on side 22 of the spike, shown in more detail in FIG. 4. As the spike is driven cam surface 23 engages an edge formed by side 24 of hole 20 and surface 25 on the plate. This camming engagement moves the spike sidewise to force the ledge into engagement with the plate. FIG. 5 is similar to FIG. 3 but illustrates the camming action. It must be noted that the forces holding the driven spike in place are generated primarily on the front face 26 of the spike and its back face 27, in contact with the end grain of the wood exposed as the spike is driven. Accordingly, the slight sidewise movement needed to engage the ledge and plate has little or no effect on the holding power of the spike.

It is considered to be understandable from this description that the subject invention meets its objectives. It provides a railroad spike which attaches the flange of a rail to the plate supporting it and also attaches the flange and thereby the plate to the supporting tie. Also, the minimum cross sectional area of the spike is only slightly less than that of an equivalent conventional spike, giving the subject spike strength roughly equivalent to the strength of a conventional spike.

It is also considered to be understood that while one embodiment of the subject invention is disclosed herein, other embodiments and modifications of the one described are possible within the scope of the invention which is limited only by the attached claims.

I claim:

1. A rail spike for use in attaching a rail having at least one flange to a plate on which said rail is supported and to a tie on which said rail and said plate are supported, said plate having an underside and an upper surface and a hole to receive said spike adjacent to said at least one flange and a juncture of said hole and said upper surface forming an edge, said spike having a head and a shank, said shank having a front surface, a back surface and a first side surface and a second side surface, said first side surface facing in a direction of the longitudinal axis of the rail and having a ledge extending from it and positioned such that when said spike is fully driven into said tie through said hole said ledge engages said underside, said second side surface facing in a direction of the longitudinal axis of the rail and being contoured to provide clearance for said ledge to pass through said hole and to engage said edge and cam said spike in a direction from said second side surface toward said first side surface to cause movement of said spike such that said ledge moves into engagement with said underside, whereby when said spike is fully driven said at least one flange and said plate are interconnected and also attached to said tie.

* * * * *